United States Patent [19]

Temburg

[11] Patent Number: 5,031,279

[45] Date of Patent: Jul. 16, 1991

[54] TEXTILE MACHINE HAVING ADJUSTABLE STATIONARY PROCESSING ELEMENTS MOUNTED ON A COMMON CARRIER ELEMENT

[75] Inventor: Konrad Temburg, Mönchengladbach, Fed. Rep. of Germany

[73] Assignee: Trützschler GmbH & Co. KG, Mönchengladbach, Fed. Rep. of Germany

[21] Appl. No.: 471,572

[22] Filed: Jan. 24, 1990

[30] Foreign Application Priority Data

Jan. 26, 1989 [DE] Fed. Rep. of Germany ..... 3902204

[51] Int. Cl.[5] ..... D01G 15/32

[52] U.S. Cl. ..... 19/104; 19/107; 19/109

[58] Field of Search ..... 19/98, 103, 104, 108, 19/107, 109, 113, 296

[56] References Cited

U.S. PATENT DOCUMENTS

| | | | |
|---|---|---|---|
| 446,015 | 2/1891 | Prest | 19/104 |
| 474,349 | 5/1892 | Gibson | 19/104 |
| 3,120,030 | 2/1964 | Reiterer | 19/109 |
| 4,286,357 | 9/1981 | Harrison, Sr. | 19/98 |
| 4,314,387 | 2/1982 | Löffler | 19/107 |
| 4,317,260 | 3/1982 | Blackburn | 19/107 |
| 4,379,357 | 4/1983 | Beneke et al. | 19/109 |
| 4,400,852 | 9/1983 | Löffler | 19/107 |
| 4,438,549 | 3/1984 | Silaneder | 19/113 |
| 4,527,307 | 7/1985 | Teichmann | 19/107 |
| 4,599,766 | 7/1986 | Wirth | 19/296 |
| 4,654,933 | 4/1987 | Horn et al. | 19/107 |
| 4,738,005 | 4/1988 | Fahmueller | 19/103 |
| 4,757,575 | 7/1988 | Vaega | 19/103 |
| 4,797,980 | 1/1989 | Jagst | 19/109 |

FOREIGN PATENT DOCUMENTS

| | | | |
|---|---|---|---|
| 110017 | 6/1984 | European Pat. Off. . | |
| 0195756 | 7/1986 | European Pat. Off. | 19/104 |
| 295060 | 12/1988 | European Pat. Off. . | |
| 1510434 | 1/1970 | Fed. Rep. of Germany . | |
| 1685571 | 6/1977 | Fed. Rep. of Germany . | |
| 3702588 | 10/1987 | Fed. Rep. of Germany . | |
| 7032783 | 3/1967 | Japan | 19/107 |
| 265128 | 8/1927 | United Kingdom . | |
| 265130 | 8/1927 | United Kingdom . | |
| 832803 | 4/1960 | United Kingdom . | |
| 971830 | 10/1964 | United Kingdom | 19/107 |
| 2191514 | 12/1987 | United Kingdom | 19/107 |
| 2205590 | 12/1988 | United Kingdom . | |

*Primary Examiner*—Werner H. Schroeder
*Assistant Examiner*—John J. Calvert
*Attorney, Agent, or Firm*—Spencer & Frank

[57] ABSTRACT

A textile fiber processing machine has a fiber processing roller; a carrier element supported in the machine immediately radially adjacent the roller and covering a circumferential portion thereof; a plurality of fiber processing elements arranged on the carrier element and cooperating with the roller; and a securing arrangement for separately adjustably mounting each fiber processing element on the carrier element.

14 Claims, 5 Drawing Sheets

TEXTILE MACHINE HAVING ADJUSTABLE STATIONARY PROCESSING ELEMENTS MOUNTED ON A COMMON CARRIER ELEMENT

CROSS REFERENCE TO RELATED APPLICATION

This application claims the priority of Federal Republic of Germany Application No. P 39 02 204.8 filed Jan. 26th, 1989, which is incorporated herein by reference.

BACKGROUND OF THE INVENTION

This invention relates to a carding machine, a cleaner or a similar fiber processing machine, particularly for cotton fibers, in which a rotating fiber processing roller is associated with a carrier element which covers circumferentially at least part of the roller periphery and on which there are arranged processing elements such as carding elements and/or cleaning elements, for example, a mote knife for waste separation.

In a known arrangement of the above-outlined type, the cleaning and carding elements are fixedly mounted on a common carrier which is radially adjustable with respect to the fiber processing roller (such as a sawtooth roller). It is a disadvantage of this prior art arrangement that by virtue of the fixed mounting of the fiber processing elements on the carrier element, changing the distance of the mote knife with respect to the roller periphery necessarily involves changing the distance of the stationary carding element and conversely. It is a further drawback of the prior art arrangement that the joint alteration of the distance from the roller periphery is possible only between narrow limits because the radius of curvature of the fiber processing roller and that of the carrier element would significantly differ from one another in case of a large distance variation, preventing an optimal cleaning and opening of the fiber material.

SUMMARY OF THE INVENTION

It is an object of the invention to provide an improved arrangement of the above-outlined type from which the discussed disadvantages are eliminated and which, in particular, makes possible an improved cleaning and opening of the fiber material and furthermore permits an improved mounting of the arrangement in the fiber processing machine.

This object and others to become apparent as the specification progresses, are accomplished by the invention, according to which, briefly stated, each fiber processing element is mounted on the common carrier element such that each fiber processing element may be adjustable independently of the others.

By virtue of the fact that the cleaning and/or carding elements, for example, mote knives, stationary carding elements and the like and also, guide elements as well as suction chambers mounted on the carrier element may be at least partially adjustable independently from one another on the common carrier element, an individual and differentiated cooperation with the associated fiber processing roller (for example, the main carding cylinder of a carding machine) is made possible. It is particularly advantageous from the point of view of the assembling operation that the common carrier element may be installed as a whole, with the fiber processing elements mounted thereon. In this manner, the structural advantage of the common carrier element with the technological advantage of an individual, optimal adjustment of the fiber processing elements with respect to the fiber processing roller may be combined.

DESCRIPTION OF THE PREFERRED EMBODIMENTS

Figure 1:
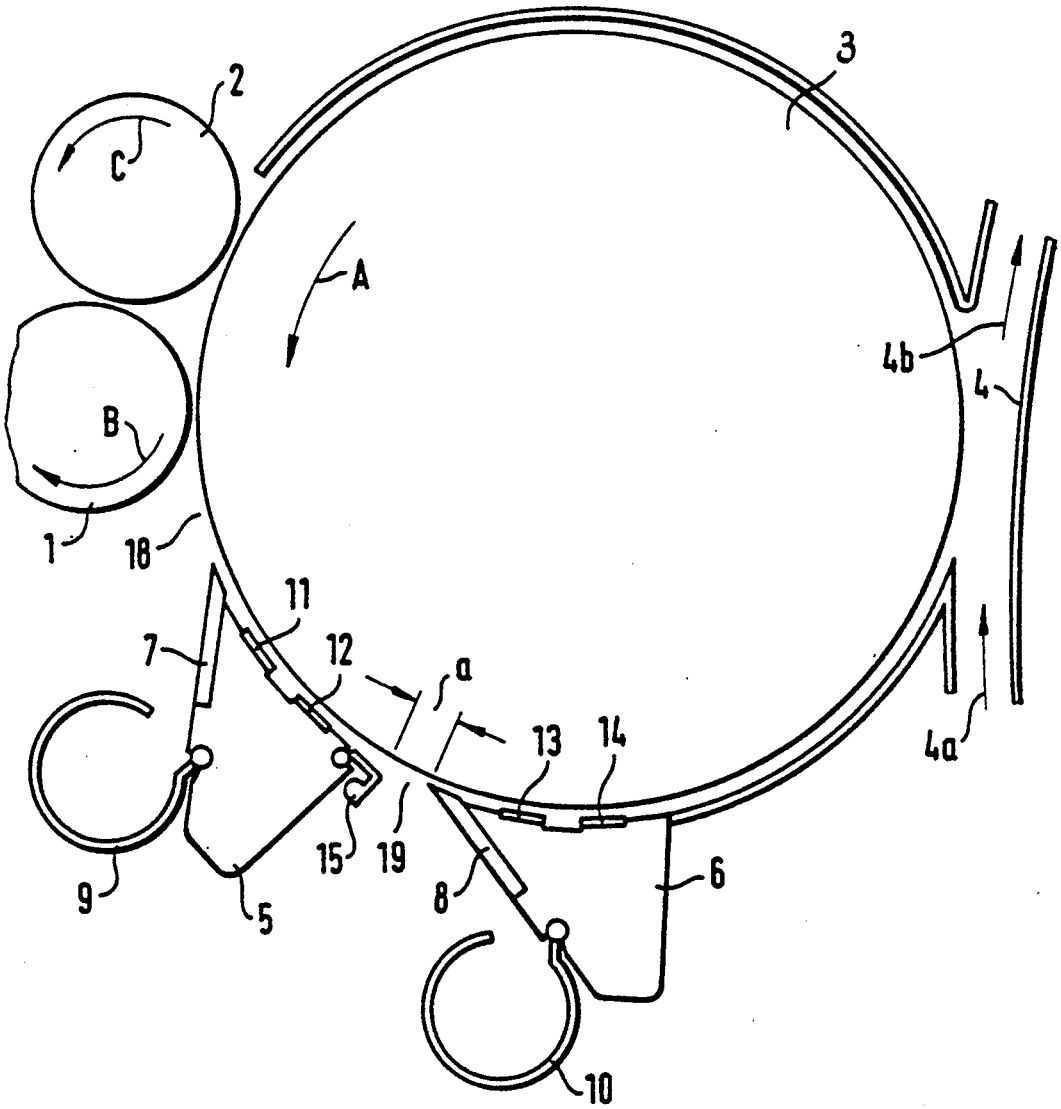
FIG. 1 is a schematic side elevational view of one part of a fiber cleaning machine incorporating two units constructed according to a preferred embodiment of the invention.

Turning to FIG. 1, there is illustrated therein a textile fiber cleaner which may be, for example, a model RSK machine, manufactured by Trützschler GmbH & Co. KG, Mönchengladbach, Federal Republic of Germany. The cleaner has two feed rollers 1, 2, a sawtooth cylinder 3 and a suction arrangement 4 which draws away the fiber material generally tangentially from the sawtooth cylinder 3. The direction of rotation of the rotating components 1, 2 and 3 is designated by arrows B, C and A, respectively. The air flow in the suction device 4 is designated by arrows 4*a*, 4*b*.

Radially adjacent the sawtooth cylinder 3 there are arranged two circumferentially spaced carrier elements 5 and 6 each supporting a respective mote knife 7, 8, a respective suction chamber 9, 10 and a pair of respective clothed stationary carding elements 11, 12; and 13, 14. At the downstream end of the carrier element 5—as viewed in the direction of rotation A of the sawtooth cylinder 3—there is mounted an adjustable guide element 15 which cooperates with the downstream-arranged mote knife 8 mounted on the carrier element 6. The distance a between the carrier element 15 and the mote knife 8 corresponds to the circumferentially measured width of a waste removal opening 19. Between the lower feed roller 1 and the mote knife 7 a waste removal (waste discharge) opening 18 is defined. The respective mote knives 7 and 8 are secured to the upstream end of the carrier element 5 and 6, respectively. The suction chambers 9 and 10 which are associated with respective mote knives 7 and 8 are operatively connected to a non-illustrated suction source.

Figure 2:
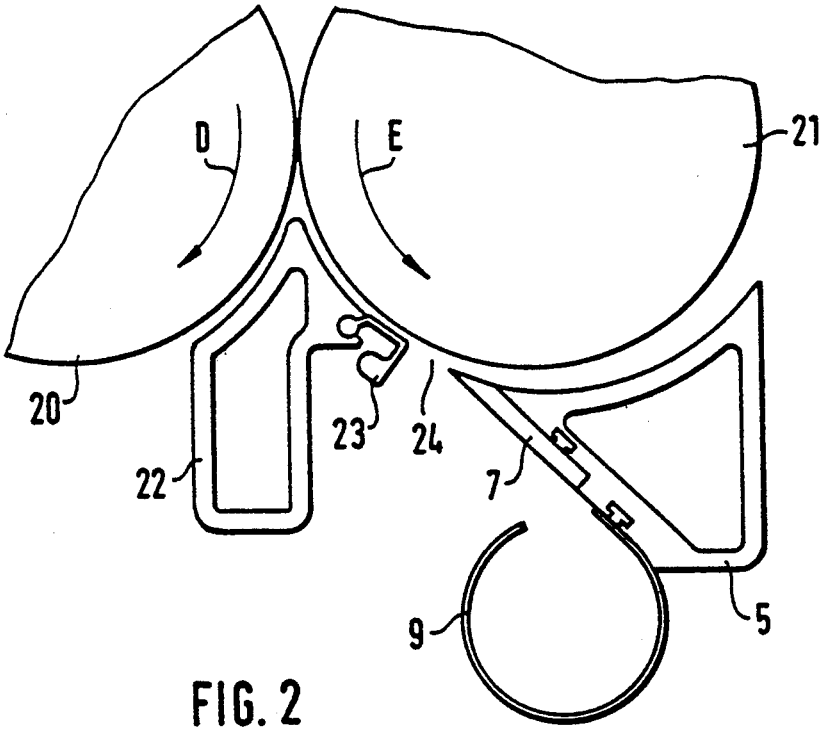
FIG. 2 is a schematic side elevational view of another preferred embodiment of the invention.

Turning to FIG. 2, with the sawtooth cylinder 3 (not shown in FIG. 2) there cooperates a clothed intermediate roller 20 and an opening and cleaning roller 21. In the zone defined between and below the rollers 20 and 21 a carrier element 22 is positioned whose downstream end, as viewed in the direction of rotation E of the roller 21 supports a guide element 23. Further, underneath the roller 21 there is supported a carrier element 5 on which there are mounted a mote knife 7 and a suction chamber 9. The mote knife 7 is circumferentially spaced from the guide element 23 and defines therewith an aperture 24 which constitutes a waste removal opening.

Figure 3:
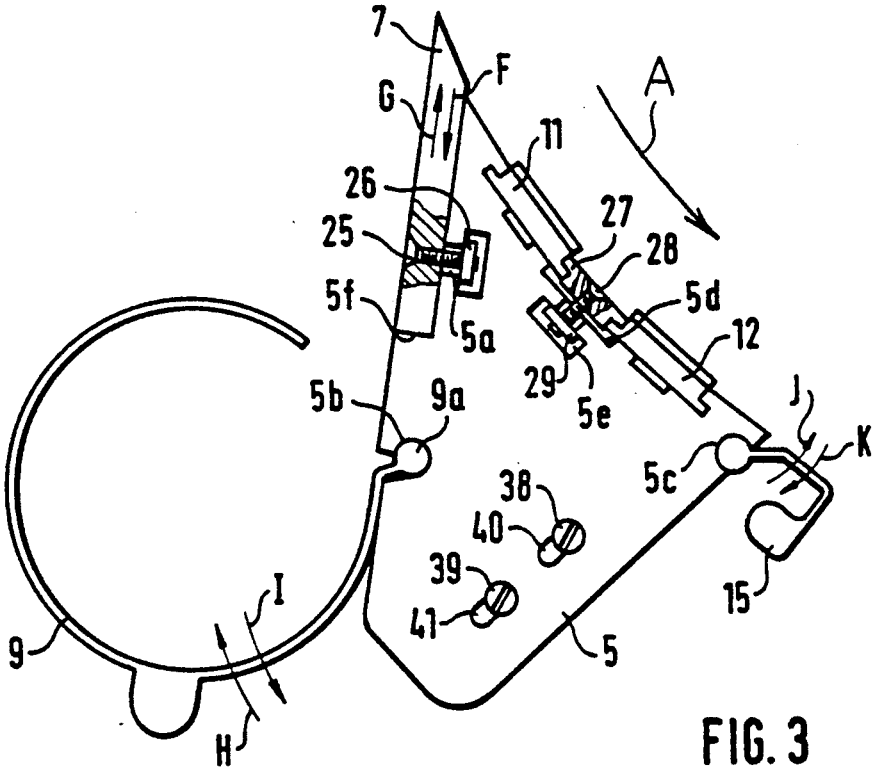
FIG. 3 is a schematic side elevational view of still another preferred embodiment of the invention.

Turning to FIG. 3, the carrier element 5 shown therein is an extruded member in which there are formed recesses 5*a*, 5*b*, 5*c*, 5*d*, 5*e* and 5*f*. The recess 5*a* is of T shape whose leg extends from an edge of the extruded body 5. The mote knife 7 which is received in the recess 5*f* is, by means of a screw 25 and a nut 26 secured in the T recess in such a manner that upon loosening the nut 26 it may be shifted in the direction of the arrows F and G. The recess 5*b* is of hollow cylindrical configuration. The cross-sectionally circular and discontinuous suction chamber 9 has, at one of its ends bounding the discontinuity, a cylindrical projection 9*a* which is supported in the recess 5*b* for journalling motion in the direction of the arrows H and I. At the downstream end of the carrier element 5 a guide element 15 is rotatably supported in the recess 5*c* and is thus movable in the direction of the arrows J and K. In the flat T-shaped recess 5*d* two stationary, carding elements 11 and 12 are disposed which are adjustably mounted in the T-recess 5*e* by means of a securing element 27, a screw 28 and a nut 29.

The carrier element 5 further has two slots 40 and 41 which are oriented radially relative to the roller (not shown in FIG. 3) with which the guide element is associated. Two securing screws 38 and 39 pass through the respective slots 40 and 41 to fasten the guide element 5 to a non-illustrated component of the cleaning machine. By loosening the screws 38, 39 the guide element 5 may be, as a unit, radially adjusted relative to the fiber processing roller with which it is associated.

Figure 4:
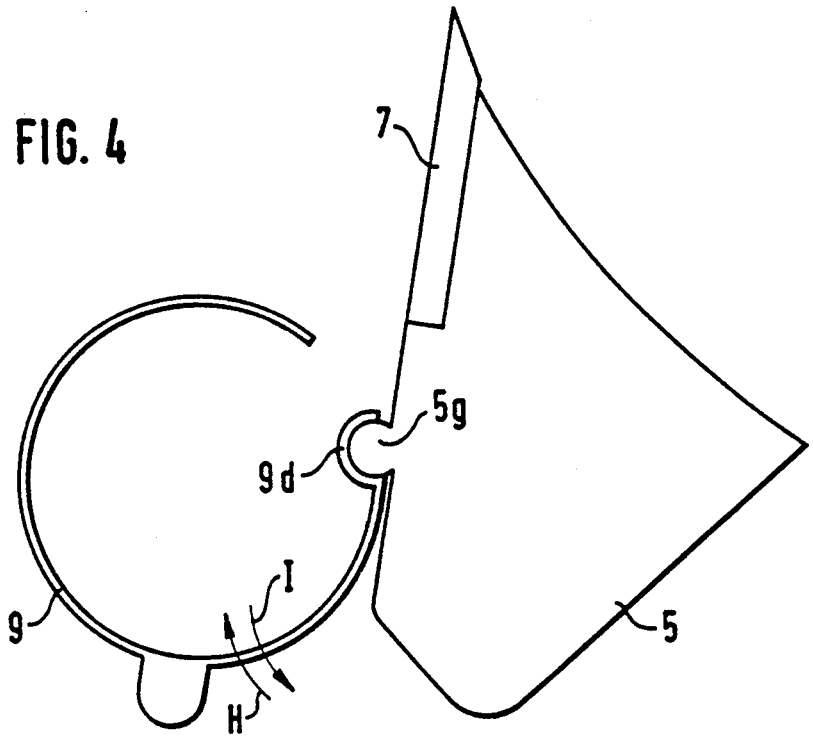
FIGS. 4, 5 and 6 are schematic side elevational views of three further preferred embodiments of the invention.

Turning to FIG. 4, in the embodiment shown therein the extruded carrier body 5 is provided with a cylindrical projection 5*g* receiving a complementally curved hollow cylindrical attachment 9*d* forming part of the suction chamber 9. This securing arrangement permits the suction chamber 9 to be pivoted, for example, with manual force, for adjustment in the direction of arrows H, I.

Figure 5:
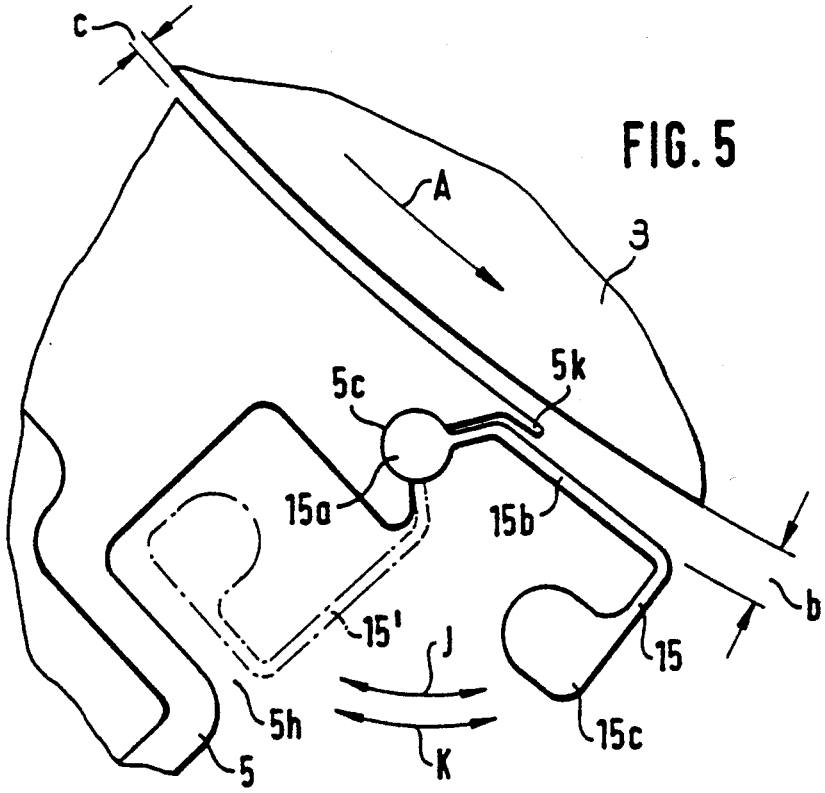

Turning to FIG. 5, the carrier element 5 has at its downstream end as viewed in the direction of rotation A of the cylinder 3, a projection 5*k* underneath which the circular recess 5*c* is situated. The cross-sectionally generally U-shaped guide element 15 has at one end a cylindrical enlargement 15*a* which is received in the cylindrical opening 5*c* such that the guide element 15 is pivotally held in the recess 5*c* for swinging motion as indicated by the arrows J and K. Thus, in order to enlarge the width of the waste discharge opening bounded by the guide element 15, the latter may be pivoted into its dash-dot line end position 15' in which it is received in a large recess 5*h* provided in the carrier body 5.

Figure 6:
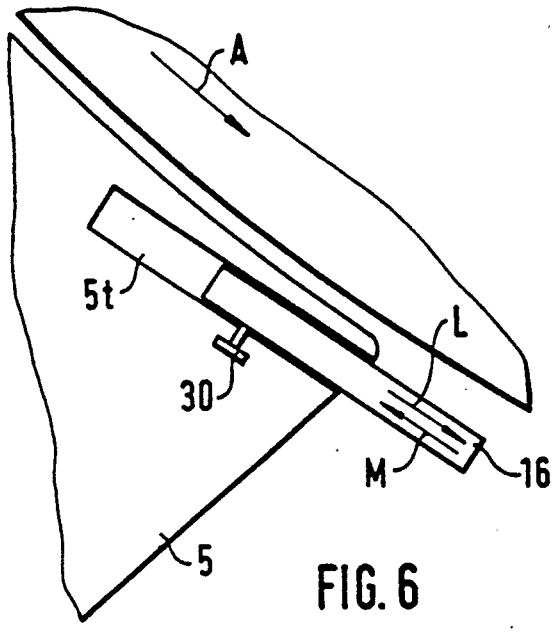

In the embodiment illustrated in FIG. 6, there is provided a linear guide element 16 which is received in a recess 5*i* of the guide element 5 for a linear adjusting motion therein, in the direction of the arrows L and M. The guide element 16 may be immobilized in any desired position by a screw 30 which tightens the guide element 16 to the carrier element 5.

Figure 7:
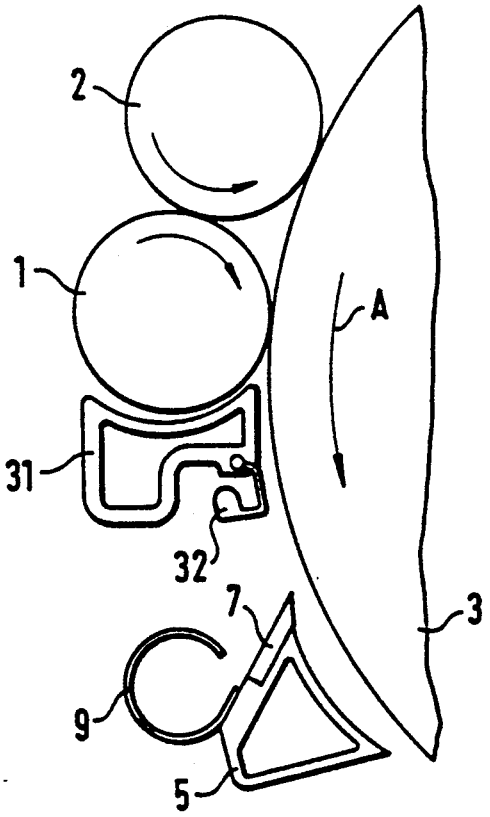
FIG. 7 is a schematic side elevational view of a fiber cleaner similar to FIG. 1 showing another preferred embodiment of the invention.

Turning to FIG. 7, underneath the feed roller 1 there is arranged a carrier element 31 which extends into the gap defined between the feed roller 1 and the sawtooth cylinder 3. In this manner, a peripheral circumferential length portion of the sawtooth cylinder 3 is covered. At the downstream end of the carrier element 31, as viewed in the direction of rotation A of the sawtooth cylinder 3 there is secured an adjustable guide element 32 which cooperates with the mote knife 7 which, in turn, is supported in a guide element 5 spaced from the guide element 31.

Figure 8:
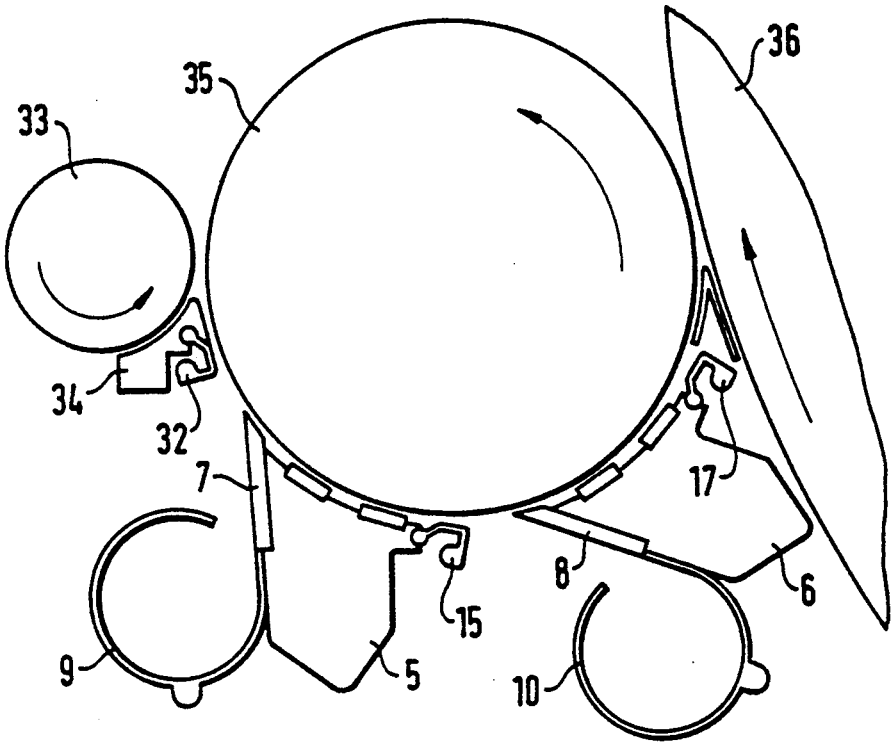
FIG. 8 is a schematic side elevational view of components of a carding machine incorporating the invention.

Turning to FIG. 8, there is shown the input zone of a carding machine which may be, for example, an EXACTACARD DK 740 model, manufactured by Trützschler GmbH & Co. KG. The carding machine has a feed roller 33, a feed table 34, a licker-in 35 a main carding cylinder 36 and a doffer 37. At the end of the feed table 34 an adjustable guide element 32 is secured which is oriented towards the licker-in 35. Underneath the licker-in 35 two carrier elements 5 and 6 are arranged which are structured as shown and described in connection with FIGS. 1 and 3.

Figure 9:
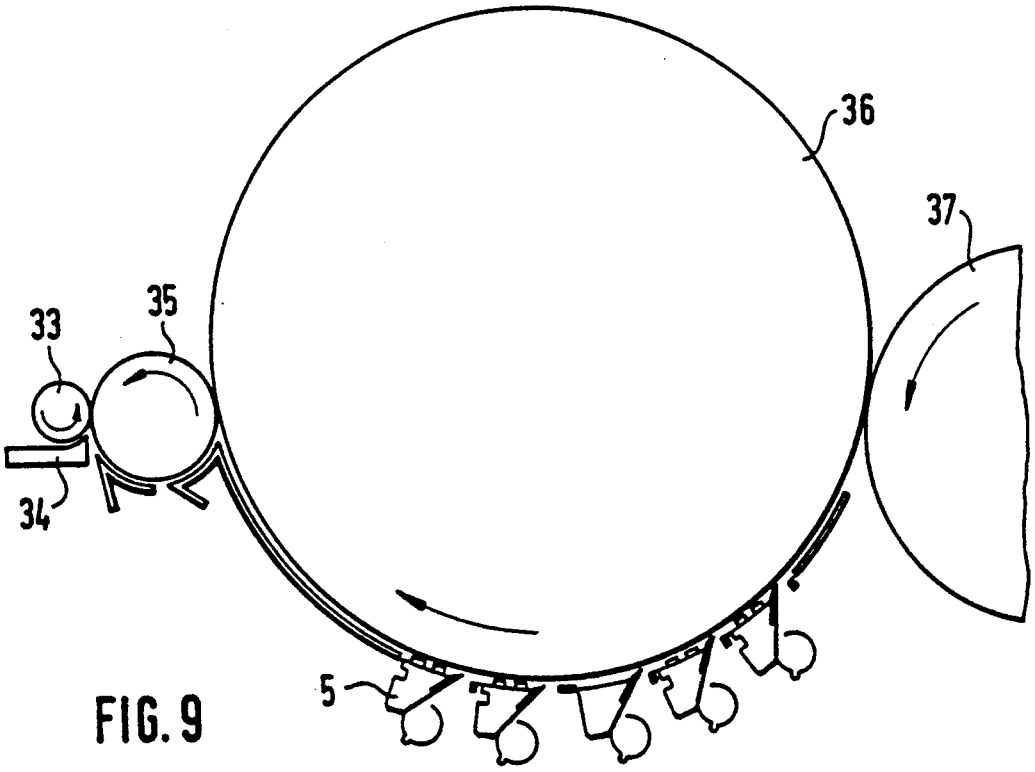
FIG. 9 is a schematic side elevational view of a carding machine illustrating preferred embodiments of the invention arranged along the main carding cylinder.

Turning now to FIG. 9, there are schematically shown other components of the carding machine illustrated in FIG. 8. Thus, with the main carding cylinder 36 there cooperates a doffer 37. Underneath the carding cylinder 36 there are arranged six carrier elements 5 structured as described in connection with FIGS. 1 and 3. The direction of rotation of the components 33, 35, 36 and 37 is designated with respective arrows drawn into those components.

It will be understood that the above description of the present invention is susceptible to various modifications, changes and adaptations, and the same are intended to be comprehended within the meaning and range of equivalents of the appended claims.

What is claimed is:

1. A textile fiber processing machine comprising a fiber processing roller having a direction of rotation; a first carrier element supported in the machine immediately radially adjacent the roller and covering a circumferential portion thereof; said first carrier element having a downstream end as viewed in said direction of rotation; a second carrier element spaced circumferentially from the first carrier element and having an upstream end as viewed in said direction of rotation; a plurality of fiber processing elements arranged on each said carrier element and cooperating with said roller; securing means for separately mounting each said fiber processing element on respective said carrier elements; each said fiber processing element being adjustable relative to one another and relative to the carrier element on which it is mounted; one of said fiber processing elements being a mote knife secured to said second carrier element at the upstream end thereof; another of said fiber processing elements being a guide element pivotally secured to said first carrier element at said downstream end thereof; said guide element being adjustable towards and away from said roller relative to said first carrier element.

2. A textile fiber processing machine according to claim 1, wherein the machine is a carding machine.

3. A textile fiber processing machine according to claim 1, wherein the machine is a fiber cleaning machine.

4. A textile fiber processing machine according to claim 1, wherein at least one of the fiber processing elements is a stationary carding element.

5. A textile fiber processing machine according to claim 1, further comprising support means for mounting said carrier element on the machine; said support means including means for adjusting said carrier element generally radially towards or away from said rollers.

6. A textile fiber processing machine according to claim 1, wherein said roller is a rapidly rotating saw-tooth cylinder.

7. A textile fiber processing machine according to claim 1, wherein said roller is a slowly rotating feed roller.

8. In a textile fiber processing machine having a fiber processing roller; a carrier plate supported in the machine immediately radially adjacent the roller and covering a circumferential portion thereof; a plurality of fiber processing elements arranged on said carrier plate and cooperating with said roller; the improvement comprising securing means for separately mounting each said fiber processing element on said carrier plate; at least some of said securing means comprising means for defining securing apertures for receiving a portion of a respective said fiber processing element; said securing apertures being formed as cutouts in edge portions of said carrier plate.

9. A textile fiber processing machine according to claim 8, wherein at least one aperture has the shape of a hollow cylinder.

10. A textile fiber processing machine according to claim 9, wherein one of said fiber processing elements is a mote knife and another of said fiber processing elements is a suction chamber cooperating with said mote knife; said suction chamber having a cylindrical portion received in said at least one aperture.

11. A textile fiber processing machine according to claim 8, wherein at least one aperture is a T-shaped cutout.

12. A textile fiber processing machine according to claim 11, wherein one of said fiber processing elements is a mote knife; said mote knife having a part received in said T-shaped cutout.

13. A textile fiber processing machine according to elements is a stationary carding element having a clothing; said stationary carding element having a part received in said T-shaped cutout.

14. A textile fiber processing machine comprising a fiber processing roller having a direction of rotation; a first carrier element supported in the machine immediately radially adjacent the roller and covering a circumferential portion thereof; said first carrier element having a downstream end as viewed in said direction of rotation; a second carrier element spaced circumferentially from the first carrier element and having an upstream end as viewed in said direction of rotation; a plurality of fiber processing elements arranged on each said carrier element and cooperating with said roller; one of said fiber processing elements being a mote knife secured to said second carrier element at the upstream end thereof; first adjusting means for adjusting said mote knife relative to said second carrier element towards or away from said roller; another of said fiber processing elements being a guide element secured to said first carrier element at said downstream end thereof; second adjusting means for adjusting said guide element relative to said mote knife for varying the distance between said mote knife and said guide element; said second adjusting means comprising a pivotal joint for allowing a change of a distance of said guide element to a periphery of said roller; said distance defining a width of a waste removal opening bounded by the first and the second carrier elements.

* * * * *